United States Patent [19]

Takenoya et al.

[11] 4,236,469

[45] Dec. 2, 1980

[54] SEWING MACHINE WITH FEED DOG DROPPING CONTROL SYSTEM

[75] Inventors: Hideaki Takenoya, Hachioji; Hachiro Makabe, Fussa, both of Japan

[73] Assignee: Janome Sewing Machine Co. Ltd., Tokyo, Japan

[21] Appl. No.: 6,685

[22] Filed: Jan. 26, 1979

[30] Foreign Application Priority Data

Jan. 26, 1978 [JP] Japan ..... 53-8268[U]
Jul. 27, 1978 [JP] Japan ..... 53-102407[U]
Oct. 26, 1978 [JP] Japan ..... 53-131014[U]

[51] Int. Cl.[3] ..... D05B 3/02; D05B 27/00
[52] U.S. Cl. ..... 112/158 E; 112/314
[58] Field of Search ..... 112/158 E, 158 R, 314, 112/315

[56] References Cited

U.S. PATENT DOCUMENTS 2,682,242 6/1954 Palme et al. ..... 112/314
4,131,075 12/1978 Wurst ..... 112/158 E
4,159,004 6/1979 Ross ..... 112/314

*Primary Examiner*—Peter P. Nerbun
*Attorney, Agent, or Firm*—Michael J. Striker

[57] ABSTRACT

A sewing machine including stitch forming device, electrically driven means for driving the needle and the feed dog, a static memory to control the electrically driven means and a pattern selecting arrangement. The electrically driven means comprise a pulse motor for controlling a horizontal feeding amount of the feed dog and a clutch solenoid operatively connected to a shaft of the pulse motor. The device is provided with a feed control arrangement having an operating member to actuate the position of the feed dog. The clutch solenoid is operatively connected to the operating member and is energized in response to a stitch signal from the static memory to define the position of the feed dog in accordance with a selected pattern.

7 Claims, 21 Drawing Figures

FIG_10

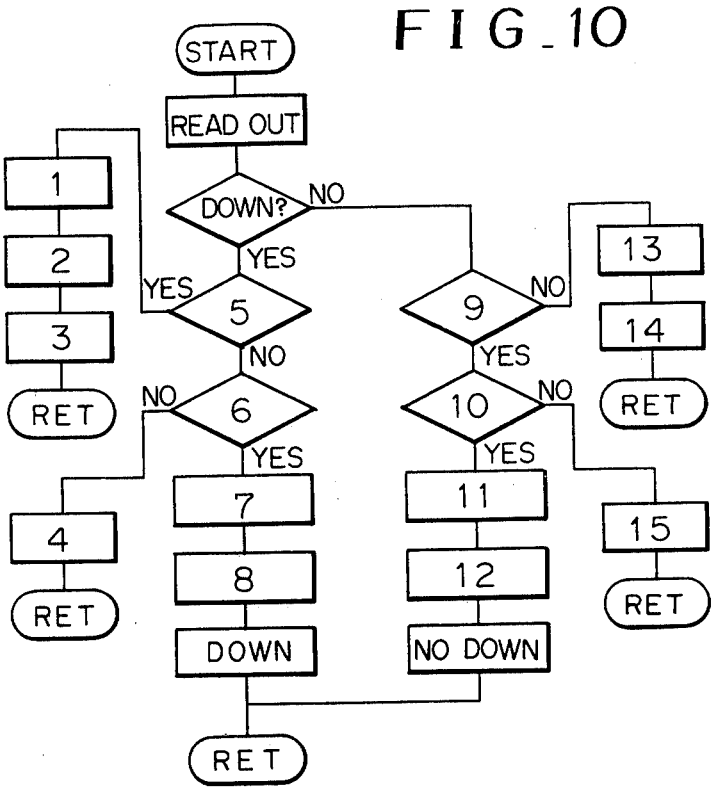

1 : High Speed Rotation of Machine
2 : Clutch Solenoid OFF
3 : Performance of Pattern Program
4 : Low Speed Rotation of Machine
5 : Precededly DOWN or not ?
6 : Low Speed Rotation of Machine or not ?
7 : Clutch Solenoid ON
8 : Pulse Motor is driven and Clutch Solenoid is energized
9 : Precededly DOWN or not ?
10 : Low Speed Rotation of Machine or not ?
11 : Clutch Solenoid OFF
12 : Pulse Motor is driven to release Element 28 from Link 33 and then Pattern Program is carried out
13 : High Speed Rotation of Machine
14 : Performance of Pattern Program
15 : Low Speed Rotation of Machine

FIG. 16

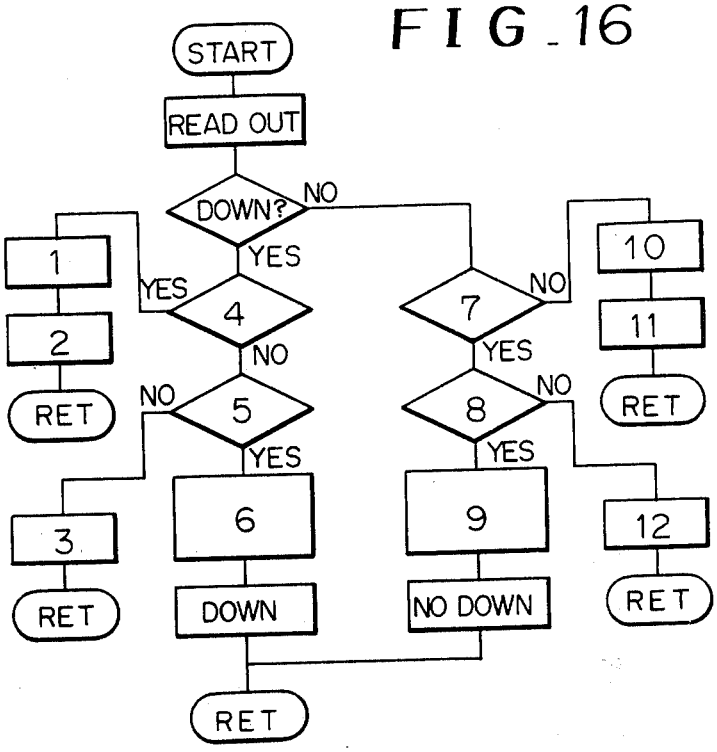

1 : High Speed Rotation of Machine
2 : Performance of Pattern Program
3 : Low Speed Rotation of Machine
4 : Precededly DOWN or not ?
5 : Low Speed Rotation of Machine or not ?
6 : Pulse Motor is driven to drop Feed Dog
7 : Precededly DOWN or not ?
8 : Low Speed Rotation of Machine or not ?
9 : Pulse Mortor is driven to allow Feed Dog to Upper Operative Position
10 : High Speed Rotation of Machine
11 : Performance of Pattern Program
12 : Low Speed Rotation of Machine

SEWING MACHINE WITH FEED DOG DROPPING CONTROL SYSTEM

BACKGROUND OF THE INVENTION

The invention relates to a sewing machine and more particularly relates to a feed dog dropping control mechanism for a sewing machine in which a pulse motor is operated by the signals from an electric control circuit to switch the feed dog to the operative condition and to the inoperative condition.

In the conventional sewing machines with a mechanical pattern generating device, the feed dog dropping mechanism has been operated by manipulation of a knob provided on the machine housing. The manipulation, however, has to overcome a considerable load applied thereto and is hard to the machine operator. Such a mechanism may be operated automatically by using a solenoid or other means. But in this case, the solenoid to be employed must be of a big capacity and requires a large space in the machine housing. Thus there have been practically many problems for operating the feed dog dropping mechanism in association with the pattern selecting elements.

SUMMARY OF THE INVENTION

The present invention has been provided to eliminate the defects and disadvantages of the conventional sewing machines.

It is a primary object of the invention to control the feed dog in association with the pattern selecting operation.

It is a second object of the invention to drive a sewing machine in a reduced speed when an electrically driven device is operated to control the feed dog, thereby to apply no substantial load to the electrically driven device.

The other features and advantages of the invention will be apparent from the following description of the invention in reference to the attached drawings. This invention is employed in a sewing machine provided, in place of a mechanical pattern generating device, with an electric pattern generating device which electrically controls both or one of the needle swinging amplitude and the feeding amount by way of electrically driven elements so as to form the predetermined stitch patterns. According to the invention, the elements for selecting the straight stitching and the zigzag stitching are electrically operated to switch the vertical reciprocating movement of the feed dog to an operative or inoperative condition.

BRIEF DESCRIPTION OF THE DRAWINGS SHOWING THE EMBODIMENTS OF THE INVENTION

FIG. 1 is a perspective view of a sewing machine provided with the invention, FIG. 2 is a simplified schmatic representation of a feeding mechanism of the sewing machine in accordance with the invention, FIG. 3 is a perspective view of a control device of the invention, FIG. 4 is a perspective view of a bracket supporting the control device of the invention, FIG. 5 is an exploded view of the control device, FIG. 6 is a perspective view of a lever operated by the control device, FIG. 7 is an exploded view of a clutch solenoid of the invention, FIG. 8 is an assembled clutch solenoid partly in a vertical section, FIG. 9 is a block diagram of an electronic control circuit controlling the control device of the invention, FIG. 10 is a flow chart for the invention, FIG. 11 is a perspective view of a control device of the invention showing a second embodiment thereof, FIG. 12 is an exploded view of the essential part of the control device, FIG. 13 is a vertical sectioned view of a shaft part of the control device, FIG. 14 is a block diagram of a electronic control circuit for controlling the control device of the second embodiment of the invention, FIG. 15 is a front elevational view of a control link of the control device shown in relation to a feed control arm, FIG. 16 is a flow chart of the block diagram of FIG. 14, FIG. 17 is a perspective view of a control device of a third embodiment of the invention, FIGS. 18 and 20 are front elevational views of the control device shown in different operations, FIG. 19 is a front elevational view of a cam on the control device, and FIG. 21 is a block diagram of a control circuit for the control device of the invention.

DETAILED DESCRIPTION OF THE INVENTION

Figure 1:
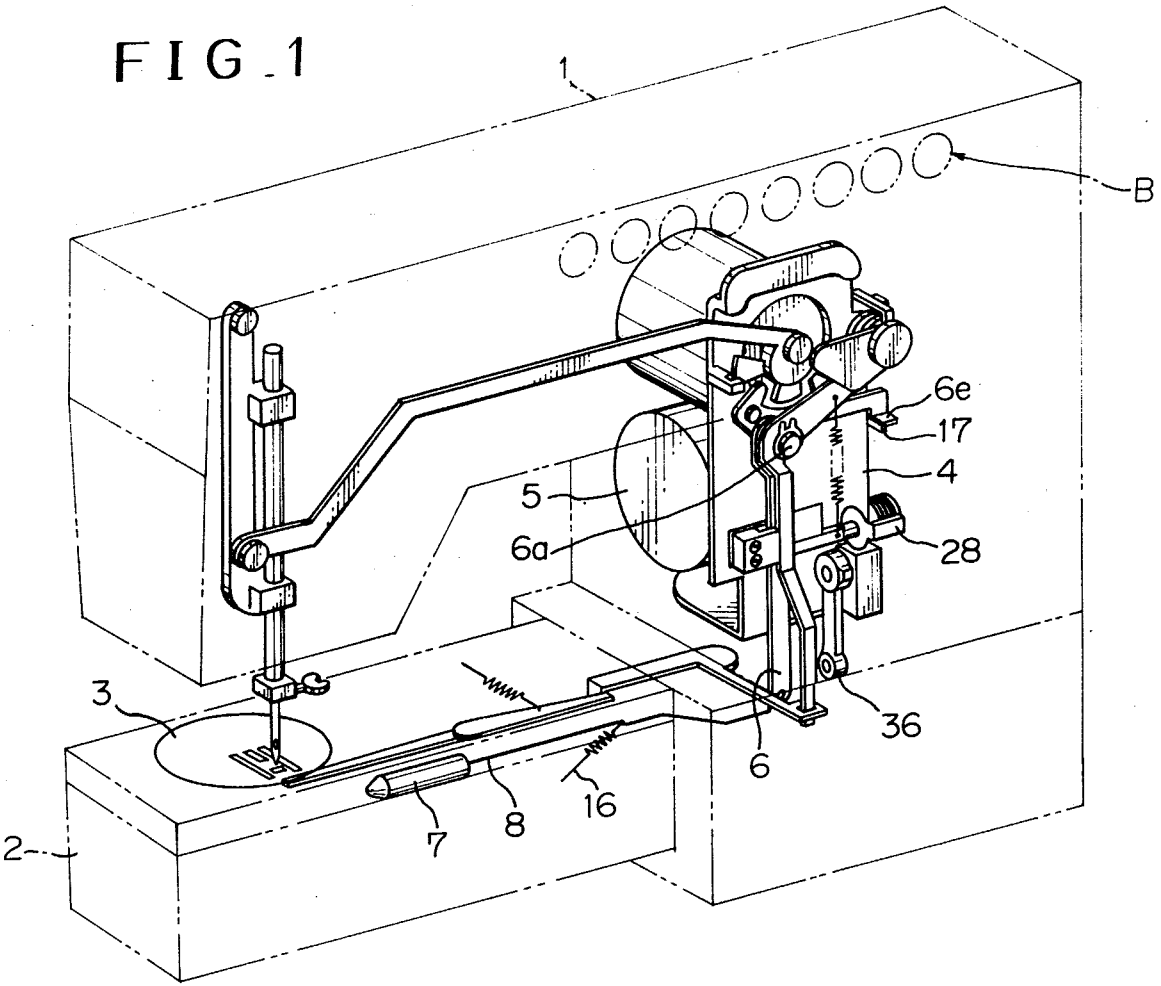
Figure 2:
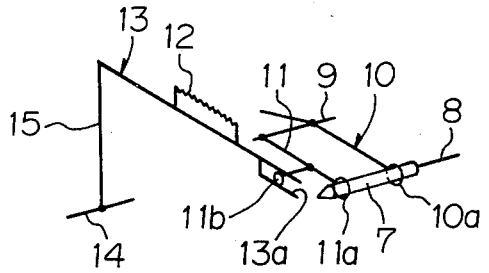
Figure 6:
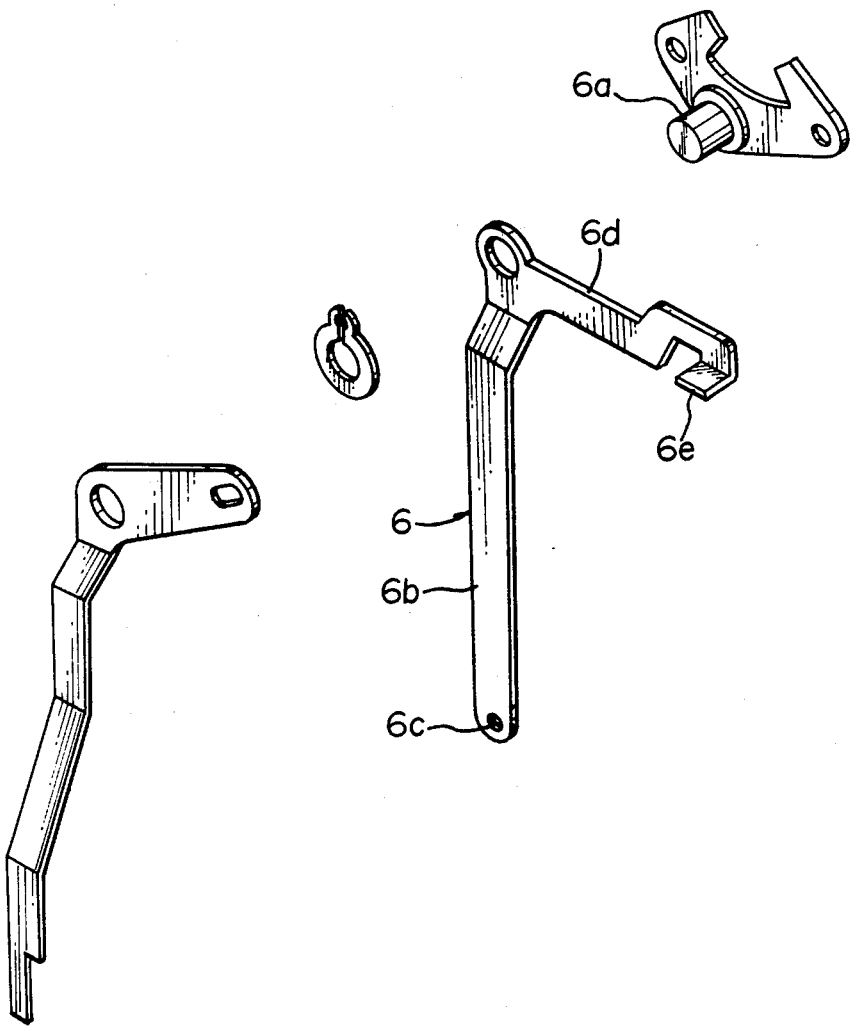

In reference to FIG. 1, the reference numeral 1 is a machine housing of a sewing machine provided with a laterally extended bed frame 2 which has a needle plate 3 arranged on the upper face thereof. The reference letter B shows collectively a plurality of pattern selecting elements arranged in a pattern selecting device of the sewing machine. The numeral 4 shows a bracket in the machine housing for supporting the necessary control devices including a pulse motor 5 for controlling a horizontal feeding amount of the feed dog of the sewing machine. As shown, an inverted L-shape lever 6 is turnably mounted on a pivot pin **6*a* secured to the bracket 4. The lever 6 has a lower end 6*c* (shown in FIG. 6) connected to a rod 8 which is connected to a plunger 7 and is axially shiftable. A schematical view of a feeding mechanism is shown in FIG. 2. This mechanism may be preferably of the type shown and described in U.S. Pat. No. 3,426,712 issued to Janome Sewing Machine Co. Ltd. The plunger 7 is, as simply illustrated in FIG. 2, axially displaced into or out of holes 10*a*, 11*a* formed respectively at the ends of a vertically swingable link 10 and a vertically swingable arm 11. The link 10 is vertically swingable in synchronism with rotation of the sewing machine by a rocking shaft 9, and the arm 11 is at the end thereof loosely mounted on the rocking shaft 9. The vertically swingable arm 11 has a lateral pin 11*b* which is inserted into a forked part 13*a* of a base 13 supporting a feed dog 12. One end of the base 13 is pivotally connected to the upper end of a link 15 which is swingable by a rocking shaft 14 to horizontally reciprocate the base 13 in synchronism with rotation of the sewing machine. Thus the feed dog 12 feeds the sewn fabric by a combination movement of the base 13 which is vertically and horizontally reciprocated. It is, therefore, apparent that the feed dog 12 is vertically moved when the plunger 7 is inserted into the holes 10*a*, 11*a* of the vertically swingable link 10 and arm 11. It is also apparent that the feed dog 12 is dropped to below the level of the needle plate 3 and becomes vertically inoperative if the plunger 7 is displaced out of the holes 10***a*, 11*a*. In FIG. 1, a tension spring 16 is at one end connected to the plunger rod 8 and is at the other end hung to the bed frame so as to bias the rod 8 in the leftward direction and the feed control lever 6 in the clockwise direction.

Figure 3:
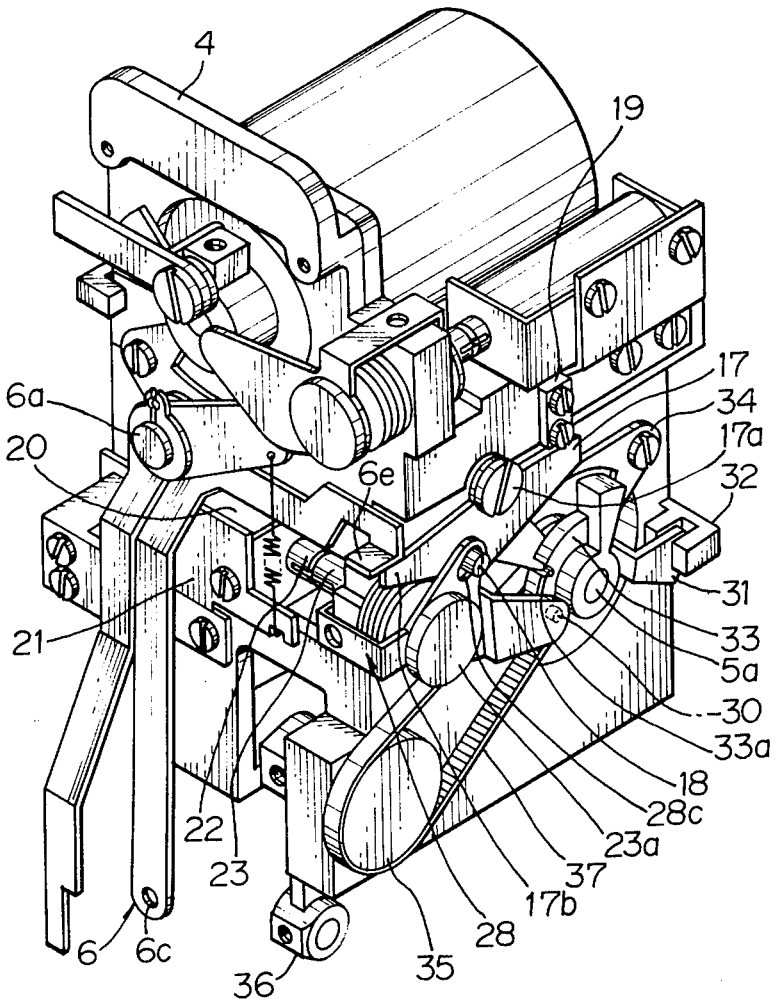
Figure 4:
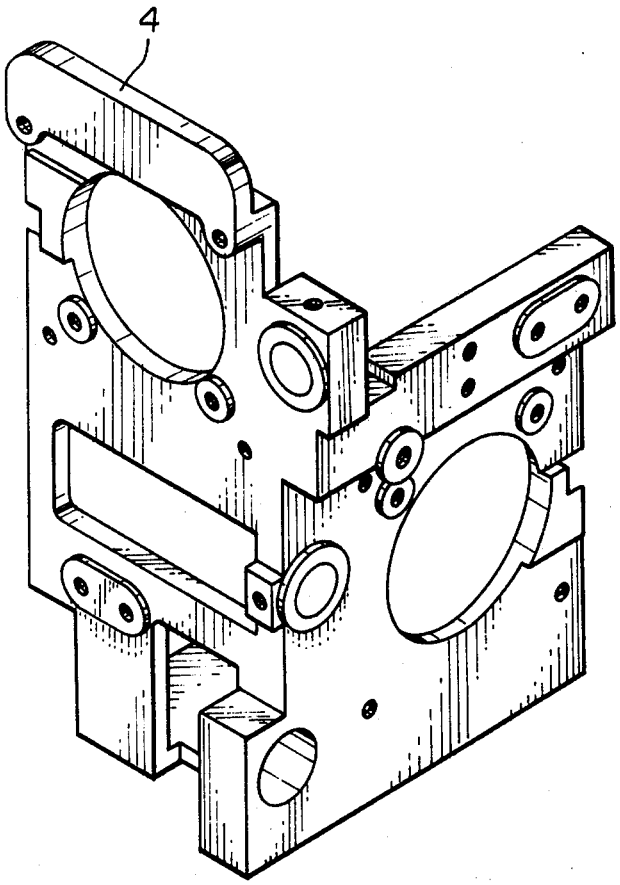

In FIGS. 1 and 3, the reference numeral 17 is a feed control arm turnably mounted on a pivot pin 17*a* secured to the bracket 4. One end 17*b* of the control lever 17 is engaged to the lower face of a horizontally bent end 6*e* of the control lever 6. Therefore the control lever 17 is biased in the counterclockwise direction by the action of the tension spring 16 influencing the plunger lever 8. A stopper 19 is secured to the bracket 4 and is engaged by the other end of the control lever 17 to limit the counterclockwise turning movement of the lever 17 having a pin 18.

Figure 7:
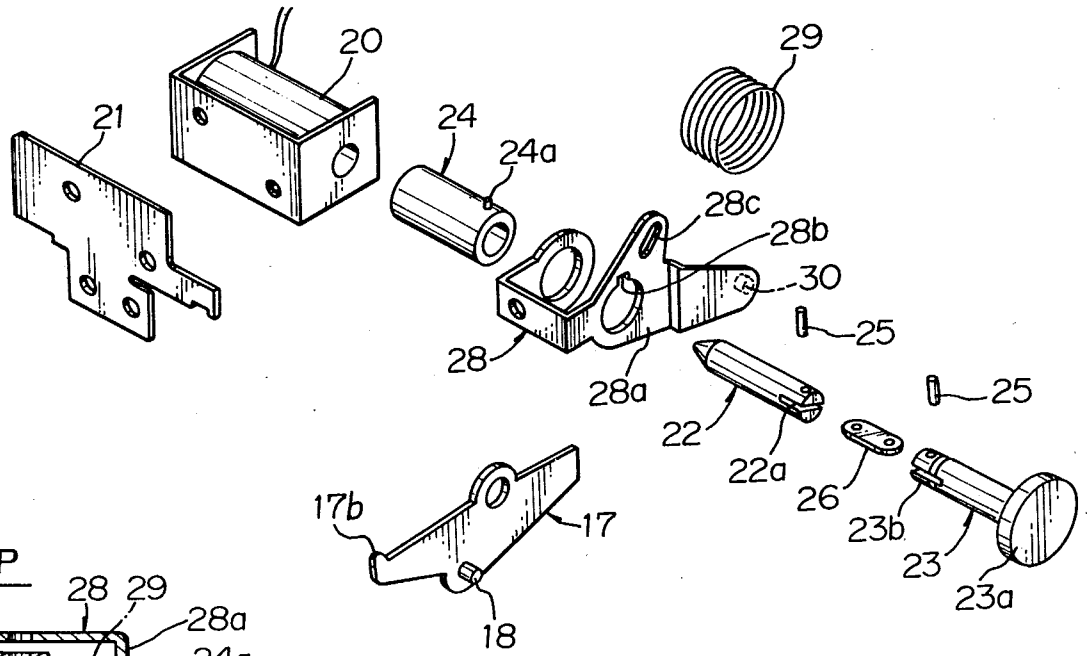
Figure 8:
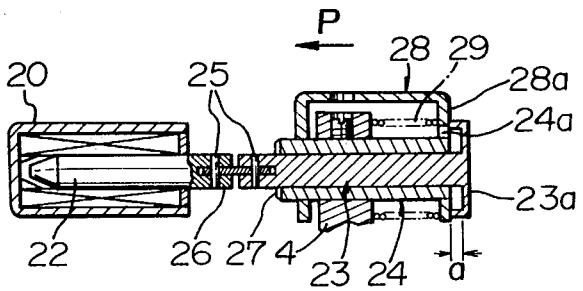

In reference to FIGS. 3, 7 and 8, the numeral 20 is a clutch solenoid secured to a support plate 21 which is secured to the bracket 4 together with the pulse motor 5. The numeral 22 is a solenoid plunger formed with an axial groove 22*a* at the outer end thereof. The solenoid plunger 22 is connected to a feed control shaft 23 by means of a connecting plate 26 which is inserted at one end into the axial groove 22*a* of the plunger 22 and is at the other end inserted into an axial groove 23*b* of the feed control shaft 23, and is connected at both ends thereof to the forms and the latter by means of pins 25, 25. The feed control shaft 23 is placed in a bushing 24 and is provided with a flange 23*a* at the outer end thereof as shown and is axially displaceable together with the solenoid plunger 22. The axial movement of the feed control shaft 23 is limited in the rightward direction by means of a stop ring 27 secured on the shaft 23. A U-shape element 28 is loosely mounted on the bushing 24 and stradles a part of the bracket 4. The wall 28*a* of the U-shape element 28 is pressed against the flange 23*a* of the feed control shaft 23 by means of a spring 29 which is mounted on the bushing 24 between the wall 28*a* and a part of the bracket 4. In this condition, a clearance (a) is provided between the flange 23*a* and the rightward end of the bushing 24, and a pin 24*a* on the bushing 24 engages a cutout 28*b* in the wall 28*a* of the U-shape element 28. The wall 28*a* has an extended part provided with a pin 30 on the inside thereof, and has another extended part provided with an oblong hole 28*c* for engaging onto the pin on the feed control lever 17.

Figure 5:
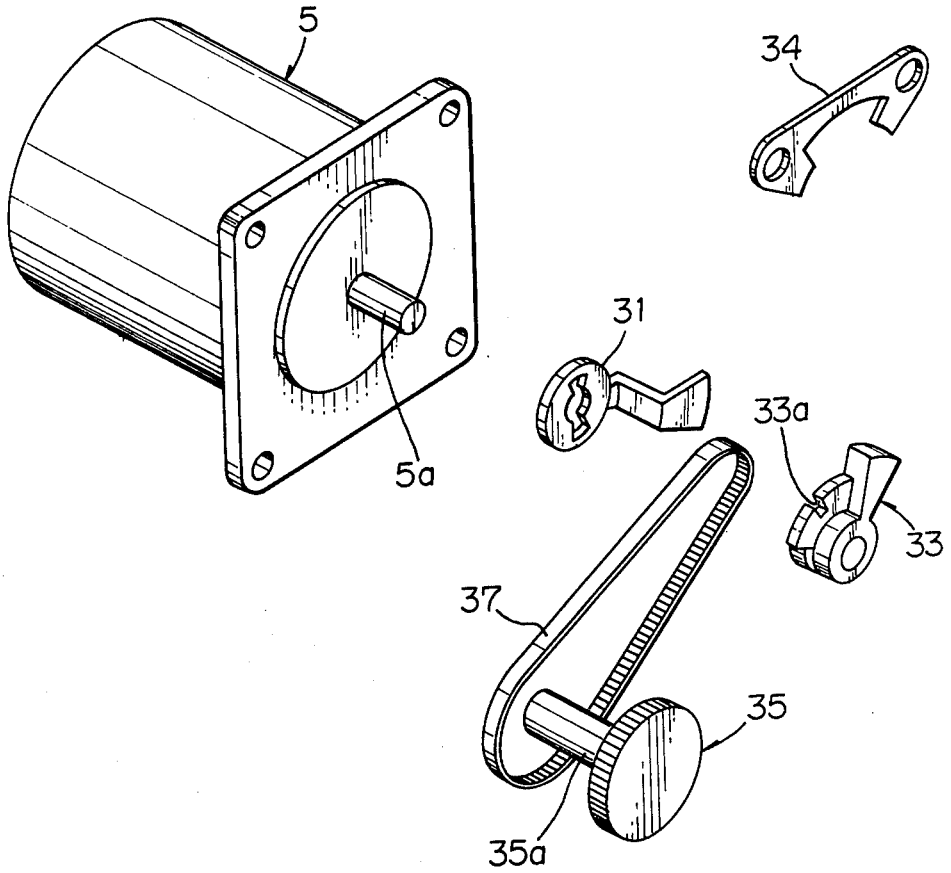

In FIGS. 3 and 5, the pulse motor 5 has a motor shaft 5*a* to which a sensor plate 31 is secured. The sensor plate 31 sets the initial angular position of the motor shaft 5 in cooperation with a block 32 which is secured to the bracket 4 and is provided with a light emitting diode and a photo transistor (not shown) for detecting the presence of the sensor plate 31. A link 33 is also secured to the motor shaft 5, and the turning movement of the link 33 is limited by a stopper 34 secured to the bracket 4. The link 33 is formed with a groove 33*a* which is to engage the pin 30 on the U-shape element 28 when the link comes to the leftward end position during the turning movement thereof. A feed control belt wheel 35 with a shaft 35*a* is turnably mounted on the bracket 4, and a feed control arm 36 is secured to the end of the shaft 35*a* on the opposite side of the bracket 4. The feed control arm 36 is connected to a feed adjusting mechanism (not shown) which is to give a horizontal movement to the feed dog 12. The link 33 and the feed control wheel 35 is connected by a timing belt 37.

Figure 9:
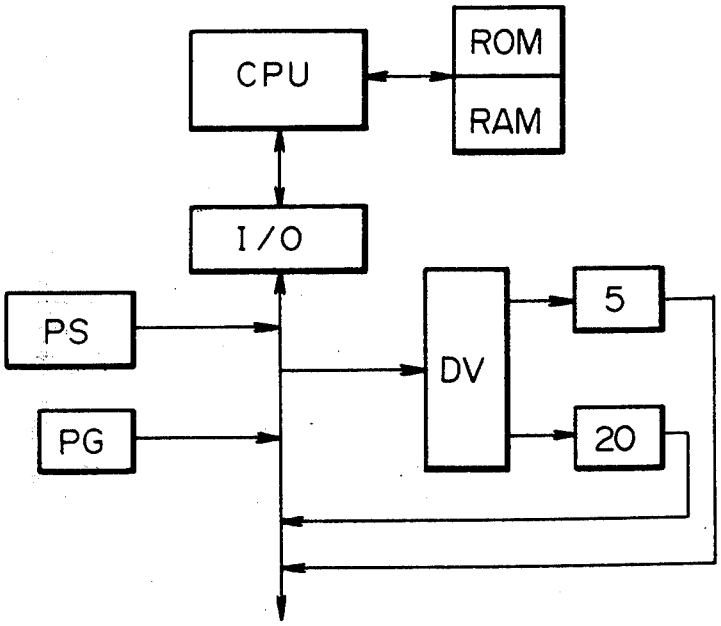

In reference to FIG. 9 showing an electronic control circuits diagram for the pulsemotor 5, the arrow marks indicate the flow of electric signals between the circuit elements. ROM is an electronic read only memory and stores a plurality of pattern stitch control signals including a signal for producing straight stitches and also stores the program controls. CPU is a central process unit for performing individual program controls. RAM is a write - read static memory for temporarily storing the processes on effects during the program performance. I/O is an input port. PS is a pattern selecting device operated by way of the pattern selecting elements (B) in FIG. 1 which select a desired pattern in such a manner that the RAM stores the pattern control signal from the ROM. PG is a pulse generator generating a pulse in synchronism with each rotation of the main drive shaft of the sewing machine. The pulse is applied to the CPU to read out a selected pattern signal from the ROM. DV is an electric drive means to drive the horizontal feed control pulse motor 5 and the clutch solenoid 20 in accordance to the signals from the CPU.

The operation of the invention will be described in reference to the flow chart in FIG. 10; IF the power source is introduced, the circuit shown in FIG. 9 becomes operative. A desired pattern is selected by manipulation of the pattern selecting elements (B in FIG. 1,) and the CPU reads out a control signal from the ROM to drivingly control the pulse motor 5 and the clutch solenoid 20 by way of the DV. If the order "DOWN" for dropping the feed dog 12 is selected by manipulation of a pattern selecting element B, it is checked whether the precedingly selected order was "DOWN" or not. If the precedingly selected order was not the "DOWN", the rotation speed of the sewing machine is reduced and then the clutch solenoid 20 is energized. Then the U-shape element 28 is pulled against the compression spring 29 in the direction P by way of solenoid plunger 22 and the control shaft 23 an shown in FIG. 8. Simultaneously the pulse motor 5 is driven and turns the feed control link 33 in the counterclockwise direction until the groove 33*a* of the link 33 engages the pin 30 on the U-shape element 28. (In this case, the horizontal feeding amount is predetermined and constant, about 2.5 mm in the forward feeding direction in this embodiment.) Subsequently the pulse motor 5 turns back the control link 33 to the end in the clockwise direction with a condition as the groove 33*a* of the link 33 is in engagement with the pin 30 of the element 28 (In this case, the horizontal feeding amount is predetermined and constant, about 2.5 mm in the backward feeding direction in this embodiment.). Since the recess 28*b* of the U-shape element 28 is displaced out of engagement with the pin 24*a* of the bushing 24 when the solenoid 20 is energized, the turning movement of the control link 33 in the clockwise direction turns the U-shape element 28 in the counterclockwise direction in FIG. 3. The counterclockwise movement of the U-shape element 28 turns the feed control lever 17 in the clockwise direction around the pivot pin 17*a*, because the control lever 17 is connected to the element 28 by the pin 18 which is secured to the lever 17 and is in engagement with the oblong hole 28*c* of the element 28. As the result, the inverted L-shape feed control lever 6 is turned in the counterclockwise direction and the plunger rod 8 is axially displaced in the rightward direction in FIG. 1, and the plunger 7 is, therefore, displaced out of engagement with the vertical swingable arm 11. Therefore the feed dog 12 is dropped to the position below the level of needle plate 3 and becomes inoperative to the sewn fabric. Then the "DOWN" condition of the feed dog 12 is memorized in the control circuit and the operation process of the circuit returns to the "START". Simultaneously the low speed rotation of the sewing machine is switched to a high speed rotation, and the clutch solenoid 20 is deenergized, and the solenoid plunger 22 and the control shaft 23 are returned to the rightward initial position. The U-shape element 28 is, however, held in the operative position on the bushing 24 by the pin 24*a* which, in this case, engages a part other than the recess 28*b* of the wall 28*a* of the U-shape element 28 which is in cooperation with the control link 33 of the pulse motor 5. Therefore the feed dog 12 is held in the dropped condition. If the order "DOWN" is repeatedly selected, the pulse motor 5 is not driven due to the fact that the "DOWN" has already been precedingly selected.

Subsequently, if a different order ("NO DOWN") other than "DOWN" is selected, the pulse motor 5 is driven by a control signal after it is checked that the sewing machine is in a low speed. Namely the control link 33 of the pulse motor 5 is turned in the counterclockwise direction and turns the U-shape element 28 in the clockwise direction until the recess 28*b* of the U-shape element 28 comes to a position in alignment with the pin 24*a* of the bushing 24. Then the U-shape element 28 is axially displaced in the rightward direction by the action of the compression spring 29 until it is stopped by the flange 23*a* of the control shaft 23 and the pin 30 of the element 28 is disengaged from the groove 30*a* of the link 33, and the engaging relation is re-established between the pin 24*a* of the bushing 28 and the recess 28*b* of the U-shape element 28. Therefore the control lever 17 is turned in the counterclocwise direction around the pivot 17*a*, and accordingly the plunger 7 is axially displaced into engagement with the hole 11*a* of the vertically swingable arm 11 by the action of the tension spring 16. As the result, the feed dog 12 is brought up to the operative position above the needle plate 3 and is vertically reciprocated in addition to the horizontal reciprocation thereof. Simultaneously the "NO DOWN" condition is memorized in the control circuit and the operation process of the circuit returns to the "START". The sewing machine is switched to a high speed from a low speed, and the pulse motor drives the horizontal feed adjusting mechanism by way of the control arm 36. According to the invention, it must be noted that the pattern or order selection is normally made when the sewing machine is standstill, but that such a pattern or order selection is possible if it is made when the sewing machine is driven in a high speed.

FIG. 10 of flow chart.

1. High Speed Rotation of Machine
2. Clutch Solenoid OFF
3. Performance of Pattern Program
4. Low Speed Rotation of Machine
5. Precededly DOWN or not?
6. Low Speed Rotation of Machine or not?
7. Clutch Solenoid ON
8. Pulse Motor is driven and Clutch Solenoid is energized
9. Precededly DOWN or not?
10. Low Speed Rotation of Machine or not?
11. Clutch Solenoid OFF
12. Pulse Motor is driven to release Element 28 from Link 33 and then Pattern Program is carried out
13. High Speed Rotation of Machine
14. Perfarmance of Pattern Program
15. Low Speed Rotation of Machine FIGS. 11–16 show a second embodiment of the invention. The explanation will be made regarding only the parts different from the first embodiment.

Figure 11:
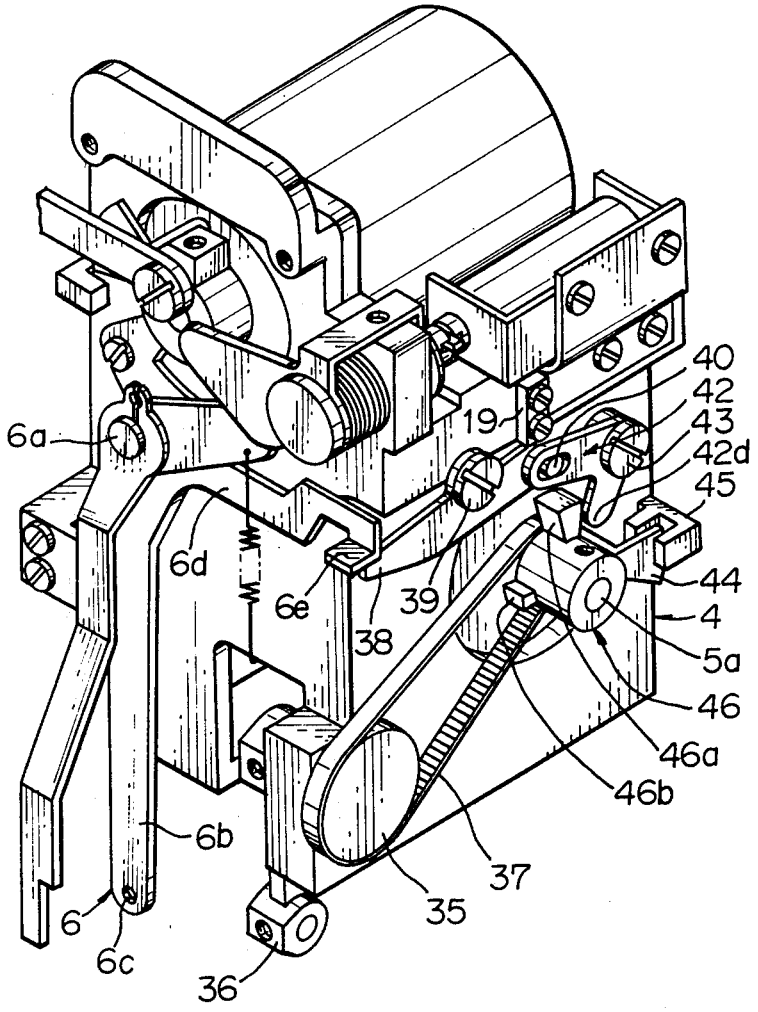
Figure 12:
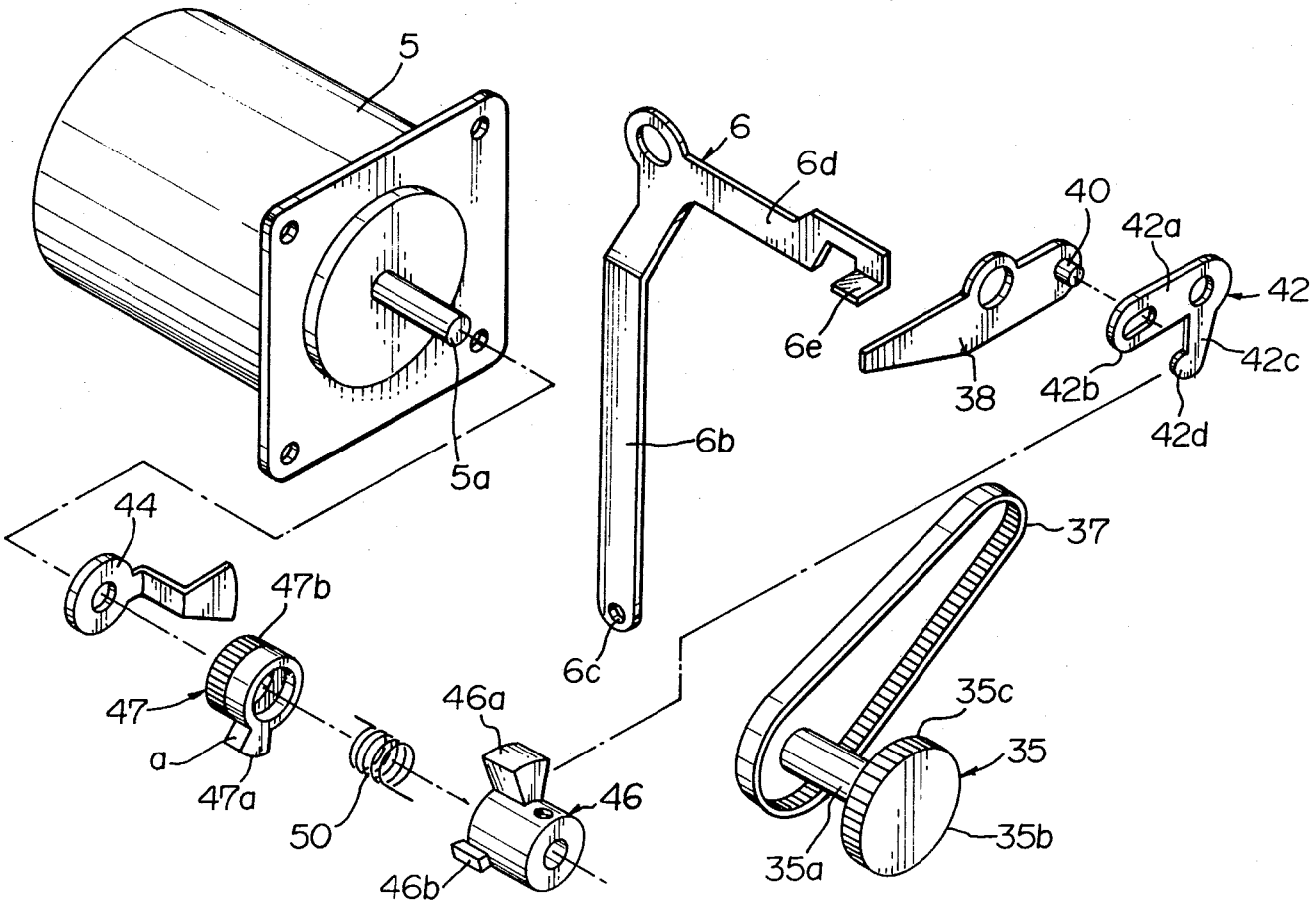
Figure 13:
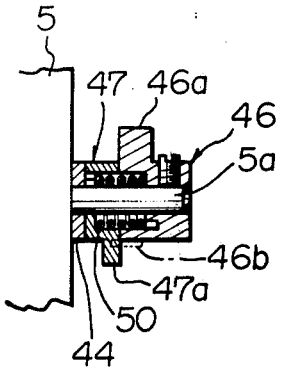
Figure 15:
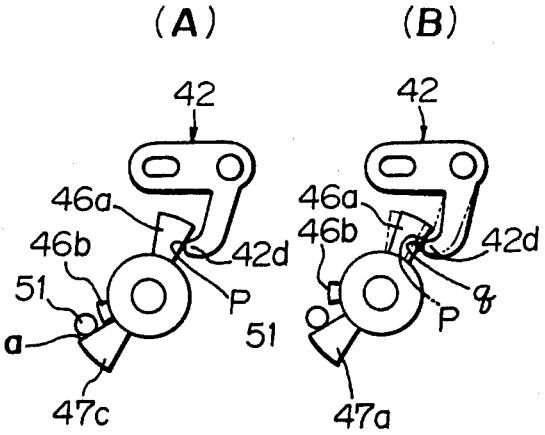
Figure 14:
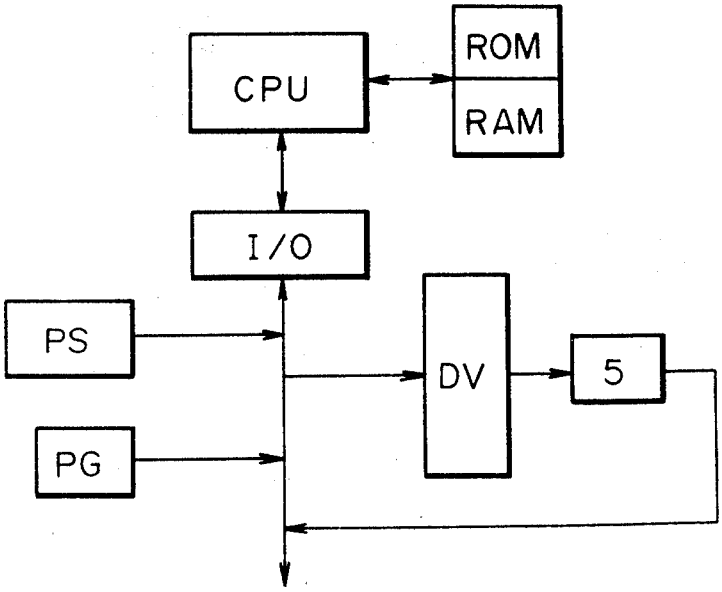
Figure 17:
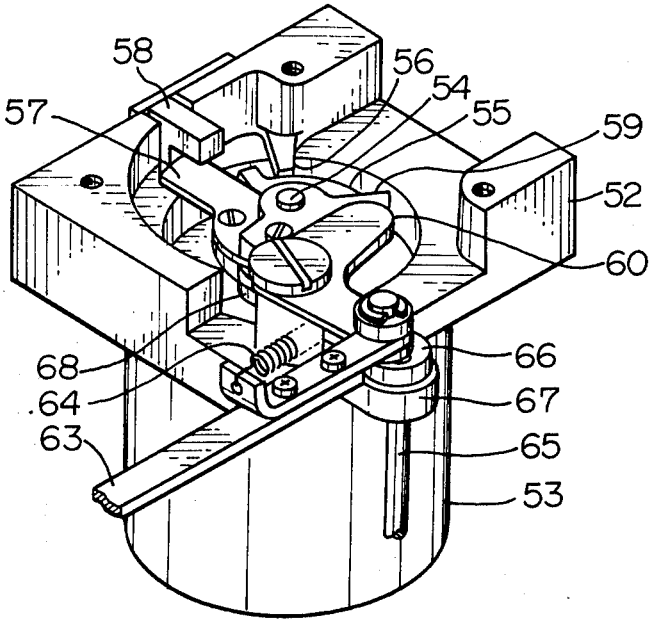

In reference to FIGS. 11–13, a control lever 38 is turnably mounted on a pivot 39 secured to the bracket 4 and the one end is engageable to the horizontally bent end 6*e* of the inverted L-shape lever 6. A pin 40 is secured to the other end part of the control lever 38. A bell-crank lever 42 is turnably mounted on a pivot 43 secured to the bracket 4. The upper arm 42*a* engages the pin 40 of the control lever 38 by way of an oblong hole formed therein. The pulse motor shaft 5*a* has a sensor plate 44 secured thereto for setting an initial position of the pulse motor 5 in cooperation with a block 44 which is secured to the bracket 4 and is provided with a light emitting diode and a photo transistor (not shown) for detecting the presence of the sensor plate 44. The pulse motor shaft 5*a* has a control element 46 secured thereto which is formed with projections 46*a* and 46*b*. A feed control element 47 is mounted on the pulse motor shaft 5*a* between the sensor plate 44 and the control element 46. The feed control element 47 is turnable relative to the shaft 5*a*, and is connected to the control element 46 by means of a coil spring 50. The feed control element 47 is formed with a projection 47*a* and a gear 47*b*. The element 47 is connected to the control element 46 by the spring 50 in such a manner that the face (a) of the projection 47*a* of the element 47 is pressed against the projection 46*b* of the control element 46 which is as shown laterally projected a little out of the inner end of the control element 46 toward the feed control element 47. The feed control element 46 is connected to the feed control belt wheel 35 which engages the gear 47*b* of the element 47 and the gear 35*b* of the wheel 35. Therefore when the pulse motor 5 is driven, the feed control element 47 is driven via the control element 46, and the feed control wheel 35 is driven to control the feed adjusting mechanism (not shown) by way of the control arm 36 secured to the control shaft 35*a* of the wheel 35. A stopper 51 is secured to the bracket 4 so as to engage the face (a) of the projection 47*a* of the control element 47, thereby to stop the rotation of the same when the control element 47 comes to an angular position corresponding to the feeding amount 2.5 mm in the backward feeding direction. On the other hand, the projection 46*a* of the control element 46 engages the arm 42*d* of the bell-crank lever 42 when the control element 46 comes to an angular position corresponding to the feeding amount 2.5 mm in the backward feeding direction. FIG. 14 shows a block diagram of the control circuit for the pulse motor 5, which is the same with that shown in FIG. 9 regarding the first embodiment of the invention.

The operation of the second embodiment will be described in reference to the flow chart of FIG. 16; If the order "DOWN" is selected by manipulation of the pattern selecting elements B, the control circuit checks if the order "DOWN" was precededly selected. If the order was not precededly selected, the rotation speed of the sewing machine is reduced in case it has been driven in a high speed, and then the pulse motor 5 is driven. With the drive of the pulse motor, the projection 46*a* of the control element 46 is turned and engages the arm 42*d* of the bell-crank lever 42 at an angular position (P)

which corresponds to the feeding amount 2.5 mm in the backward direction as shown in FIG. 15A. As the control element 46 is further turned, the projection 47*a* of the feed control element 47 engages the stopper 51, and the rotation of the element 47 is stopped. The control element 46 is, however, continuously turned in the clockwise direction until the projection comes to an end position which corresponds to the feeding amount 4 mm in the backward direction. In this case, the arm 42*d* of the bell-crank lever 42 is displaced from the position (P) to the position (q) in the counterclockwise direction as shown in FIG. 15B. With this turning displacement of the bell-crank lever 42, the control lever 38 is turned around the pivot 19 in the clockwise direction. As the result, the inverted L-shape lever 6 is turned in the counterclockwise direction against the action of the tension spring 16. Thus the feed control plunger 7 is axially displaced and disengaged from the hole 11*a* of the vertically swingable arm 11, and the feed dog 12 is dropped to the inoperative position below the level of the needle plate 3 in the same manner as described in the first embodiment. Then the "DOWN" condition of the feed dog 12 is memorized in the control circuit and the operation process of the circuit returns to the "START", and simultaneously the machine is switched from the low rotation speed to a high rotation speed. If the order "DOWN" is repeatedly selected, the pulse motor 5 is not driven.

Subsequently if an order "NO DOWN" is selected, the control circuit checks that the sewing machine is driven in a reduced low speed, and drives the pulse motor 5 in the reverse direction and alows the arm 42*d* of the bell-crank lever 42 to return to the position (P) from the position (q), Therefore the control lever 38 is turned in the clockwise direction allowing the inverted L-shape lever 6 to turn in the clockwise direction due to the action of the tension spring 16. As the result, the feed control plunger 7 is axially displaced into engagement with the hole 11*a* of the vertically swingable arm 11, and the feed dog 12 is brought up to the operative position above the level of the needle plate 3. Then the "NO DOWN" condition is memorized in the control circuit and the operation process of the control returns to the "START", and the sewing machine is switched from the reduced speed to the high speed. Then the pulse motor 5 is disconnected from the feed dropping mechanism and controls only the feed adjusting mechanism (not shown) by way of the feed control arm 36.

FIG. 16—flow chart

Figure 18:
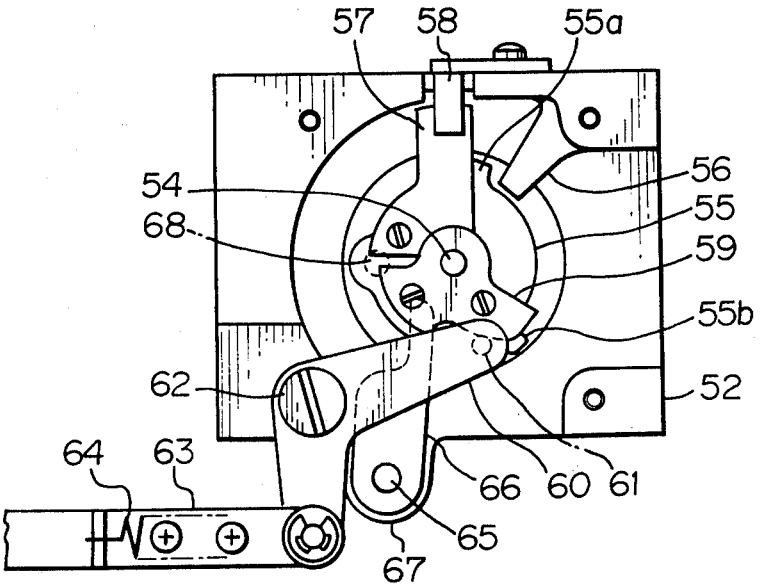
Figure 19:
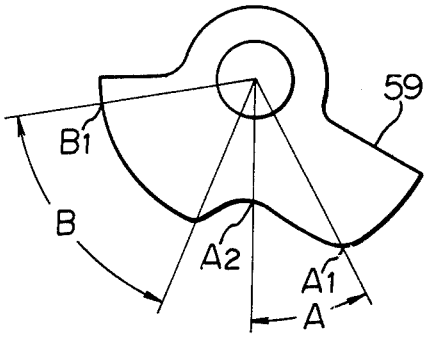

1. High Speed Rotation of Machine
2. Performance of Pattern Program
3. Low Speed Rotation of Machine
4. Precededly DOWN or not?
5. Low Speed Rotation of Machine or not?
6. Pulse Motor is driven to drop Feed Dog
7. Precededly DOWN or not?
8. Low Speed Rotation of Machine or not?
9. Pulse Motor is driven to allow Feed Dog to Upper Operative Position
10. High Speed Rotation of Machine
11. Performance of Pattern Program
12. Low Speed Rotation of Machine FIGS. 17–21 shows a third embodiment of the invention. In this embodiment, a pulse motor 53 for controlling the lateral swinging movement of the needle is secured to a bracket 52 which is fixedly mounted in the machine housing. The pulse motor 53 has a central drive shaft 54 which is as shown fixedly provided with a base element 55. The base element 55 is formed with projections 55*a*, 55*b* with a space therebetween on the periphery thereof. The rotation of the base element 55 is limited by a stopper 56 formed on the bracket 52. A sensor or a light screening plate 57 is secured to the base element 55 to cooperate with an element 58 provided with a light emitting diode and a photo transistor and is fixedly mounted on the bracket 52 to generate a signal indicating an angular position of the motor shaft 54. A needle swinging control cam 59 is secured to the base element 55. The control cam 59 has on the periphery thereof a region A for controlling the needle swinging mevemement and a region B for controlling the exchange of the needle hole of the needle plate from the needle hole for straight stitches to the one for zigzag stitches and vice versa as shown in FIG. 19. The control cam 59 is engaged by a pin 61 secured to one end of a L-shape lever 60 which is turnable around a pivot 62 on the bracket 52. The L-shape lever 60 is at the other end connected to a transmission rod 63 for controlling the needle swinging movement. The L-shape lever 60 is held in engagement with the control cam 59 by means of a spring 64 biasing the lever 60 in the counterclockwise direction as shown in FIG. 18. When the pin 61 engagles the point (A1) of the control cam 59, the transmission rod shifts the needle to the extreme left end of the whole needle swinging region. On the other hand, when the pin 61 engages the point (A2) of the control cam 59, the transmission rod 63 shifts the needle to the extreme right end of the whole needle swinging region. When the pin 61 engages the region B of the control cam 59, the needle is in the center position of the whole needle sweinging region.

Figure 20:
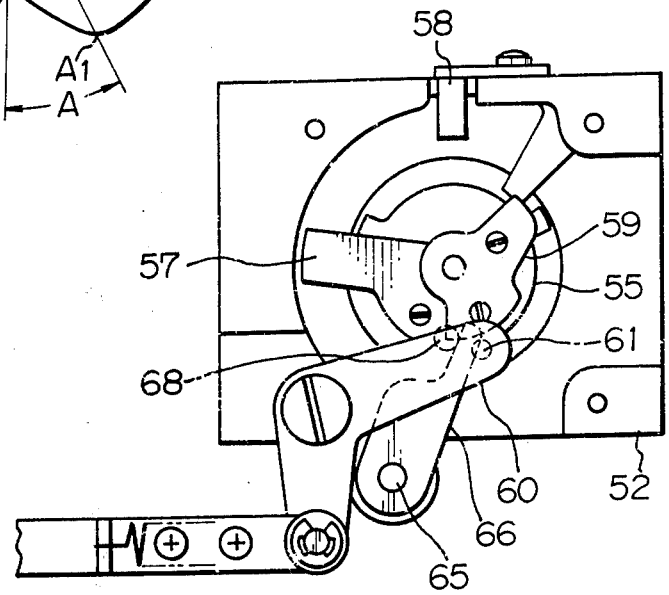

Reference numeral 65 is a control shaft for changing the needle hole of the needle plate, and has a control arm 66 secured thereto. The control shaft 65 is turnably mounted on a boss 67 of the bracket 52. The control lever 66 is pressed against a stopper (not shown) by a spring (not shown) in the counterclockwise direction to the position as shown in FIG. 18. As shown a pin 68 is secured to the base element 55. The pin 68 is adapted to engage the control lever 66 and turns the same in the clockwise direction if the base element 55 is turned in the counterclockwise direction together with the motor shaft 54. In this case, the pin 61 of the needle swinging control lever 60 engages the region B of the control cam 59 as shown in FIG. 20 which shows that the pulse motor 53 has been driven in the counterclockwise direction to the maximum extent to set the sewing machine to a condition for stitching the straight stitches, in which the needle has been brought to the center position and the needle hole has been reduced for the straight stitches from the laterally extended zigzag stitching needle hole. On the other hand, FIG. 18 shows that the sewing machine has been set to a condition for stitching the zigzag stitches in which the needle has been brought to a position defined by the region A of the control cam 59 and the needle hole has been laterally enlarged for zigzag stitches from a reduced hole for straight stitches. The light screening plate 57 is positioned on the base element in respect to the photo emitting element 58 so as to engage the pin 61 to the point (A1) of the control cam 59 corresponding to the reset position of the pulse motor 53 when the power source is introduced.

Figure 21:
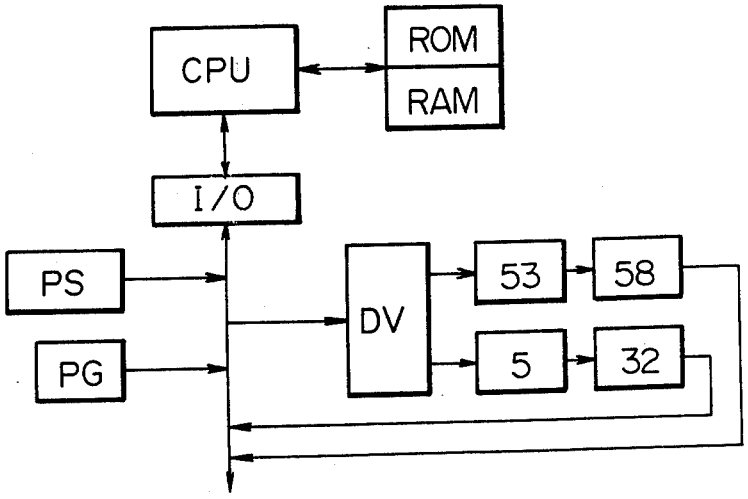

FIG. 21 shows a block diagram of control circuit for the third embodiment, in which the solid lined arrow marks indicate the flow of electric signals between the circuit elements and the broken lined arrow marks indicate mechanical relations of the elements. The block diagram will be explained regarding only the points different from the block diagram of FIG. 9; DV is an electric drive device for controlling the needle swinging mevement and the feeding movement, and drives the needle and needle hole control pulse motor 53 and the feed control pulse motor 5 in accordance to the signals from the central processing unit (PCU). Reference numerals 58, 32 are sensors respectively cooperating with the respective light screening plates 57, 31 generate a pulse signal which is transmitted to the central processing unit (PCU) for resetting the respective pulse motors 53, 5.

The operation of the third embodiment is as follows; If the power source is introduced, the circuit in FIG. 21 becomes operative. In this instance, if the screening plate 57 is not in alignment with the sensor element 58 as shown in FIG. 20, the pulse motor 53 is driven to a reset position as shown in FIG. 18 where the screening plate 57 is in alignment with the sensor 58. Simultaneously the central processing unit PCU checks by the signal from the pulse generator PG that the needle is positioned approximately at the upper dead point. In this condition of FIG. 18, the needle hole control lever 66 is in an extreme end position in the counterclockwise direction and therefore the laterally extended needle hole is provided for zigzag stitches, and the pin 61 engages the region A of the control cam 59. Therefore if a pattern including zigzag stitches is selected by way of pattern selection device PS, the pattern can be stitched. Namely the pulse motor 53 is driven within the confined region A of the control cam 59 by the electric drive device DV which is operated by the central processing unit PCU receiving a pulse per stitch from the pulse generator PG to read out stitch control signals from the static mamory ROM for the selected pattern.

Subsequently if the straight stitching is selected by manipulation of the pattern selecting device PS, the electric drive device DV drives the pulse motor 53 in dependence upon the control signals from the static memory ROM which is read out by the central processing unit PCU. As the result, the control lever 66 is turned by the pin 68 in the clockwise direction to the position as shown in FIG. 20 and the precededly selected zigzag stitching needle hole is reduced to a straight stitching one. In this instance, the pin 61 engages the region B of the control cam 59, and therefore the needle is shifted to the center position by way of the transmission rod 63. The needle hole replacing operation is finished when the pin 61 comes to engage the point (B1) of the control cam 59. This operation is, of couse, carried out after it is confirmed by the control circuit that the needle is positioned at the upper dead point thereof. According to the invention, it can be easily conceived that the other function, for example, an automatic thread cutting may be realized by providing an additional control lever such as 66 and also by providing an additional control cam such as the cam 59 so as to hold the needle position unchanged when the thread cutting operation is made.

We claim:

1. A sewing machine, comprising: stitch forming means for changing positions of the needle and the fabric to be sewn; electrically driven means for driving the needle and the feed dog; electronic control means including a static memory storing means for providing stitch control signals adapted for controlling said electrically driven means; pattern selecting means operated by reading out said stitch control signals from said static memory storing to drive said electrically driven means in accordance with a selected pattern; and feed control means for controlling the position of the feed dog including an operating member adapted for moving the feed dog between operative and inoperative positions, said electrically driven means including a pulse motor for controlling a horizontal feeding amount of the feed dog and having an outwardly extending shaft, and a clutch solenoid operatively connected thereto, said clutch solenoid being operatively connected to said operating member and being energized in response to a corresponding stitch signal from said static memory storing means.

2. The sewing machine of claim 1, wherein said pulse motor has a control link connected to said shaft and formed with a groove on a peripheral surface thereof, and said clutch solenoid is provided with a spring biased link having a pin at an end thereof, said pin is arranged to engage said groove in the operative position.

3. The sewing machine of claim 2, wherein an intermediate lever is provided to operatively connect said spring biased element to said operating member.

4. The sewing machine of claim 1, wherein said pulse motor is provided by sensor means for resetting an initial position thereof.

5. The sewing machine of claim 1, wherein a control element is mounted on said outwardly extending shaft, a bell-crank link is provided with one arm engaging said control element, an intermediate link is provided, one end of which is arranged to engage a second arm of said bell-crank link, and the opposite end of which is adapted to engage said operating member.

6. The sewing machine of claim 1, wherein said electrically driven means for driving the needle and the feed dog include a pulse motor for controlling the lateral swinging movement of the needle having an outwardly extending shaft, a control cam is mounted on said shaft and a lever is provided with one end carrying a pin which engages said control cam and with a second end connected to a transmission rod operatively connected to the needle.

7. The sewing machine of claim 6, further including means for changing the needle hole from the straight switching for zigzag switching and vice versa having a base element mounted on said shaft coaxially to said control cam and carrying a pin, a control lever and a control shaft connected thereto, said pin actuates said control lever during rotation of said shaft whereby said control shaft actuates the needle hole changing device.

* * * * *